United States Patent [19]

Deimel

[11] 4,080,237

[45] Mar. 21, 1978

[54] METHOD AND APPARATUS FOR STICKING DOWN FILLET SEAM ON A PACKAGE

[75] Inventor: Gerhard Deimel, Opladen, Germany

[73] Assignee: Jagenberg Werke AG, Dusseldorf, Germany

[21] Appl. No.: 675,012

[22] Filed: Apr. 8, 1976

[30] Foreign Application Priority Data

May 7, 1975 Germany ..... 2520502

[51] Int. Cl.[2] ..... B65B 7/20; B65B 51/10; B65B 51/32

[52] U.S. Cl. ..... 156/226; 53/375; 156/227; 156/290; 156/320; 156/497; 156/498; 156/499

[58] Field of Search ..... 53/375, 45, 46, 373, 53/377, 379; 93/36.3, 36.8, 44.1 GT, 49 R, 52; 156/226, 227, 290, 311, 320, 497, 498, 499, 306, 309, 443; 229/17 G

[56] References Cited

U.S. PATENT DOCUMENTS

| | | | |
|---|---|---|---|
| 2,377,103 | 5/1945 | Pittman | 93/36.8 |
| 2,444,143 | 6/1948 | Palmer | 93/36.8 |
| 2,695,745 | 11/1954 | Dixon | 229/17 G |
| 3,263,391 | 8/1966 | Wallsten | 93/44.1 GT |
| 3,380,229 | 4/1968 | Nelson | 156/497 |
| 3,562,920 | 2/1971 | Vuilleumier et al. | 53/375 |
| 3,610,114 | 10/1971 | Kaminsky | 93/52 |
| 3,751,876 | 8/1973 | Oakley et al. | 93/36.3 |
| 3,777,448 | 12/1973 | Howe | 53/375 |

*Primary Examiner*—William A. Powell
*Attorney, Agent, or Firm*—Burgess, Dinklage & Sprung

[57] ABSTRACT

A method for flat pressing and sticking down of a fillet seam of a roof-shaped folding closure of a package whose outside surface is provided with a thermoplastic material, comprising transporting the package in a direction transverse to the fillet seam, heating a first area of the side surface of the fillet seam rearward of the seam relative to the direction of transport and heating a second area of the outside surface of the package complementary with the first area, and transporting the heated package past a stationary member positioned so as to press the fillet seam and cause it to stick down to the outside surface of the package. A third and fourth area respectively on the side surface and on the package and respectively spaced from the first and second areas can also be heated to form two spaced stuck down areas. By pulling upward therebetween, the seam can be raised for opening the package. A corresponding apparatus is provided and the stationary member may have a leading inclined portion so as to effect the pressing down progressively. Means may also be provided to cool the stationary member and set the sticking down.

7 Claims, 2 Drawing Figures

METHOD AND APPARATUS FOR STICKING DOWN FILLET SEAM ON A PACKAGE

BACKGROUND

The invention relates to a method for the flat pressing and cementing of a fillet seam on the upper, especially roof-shaped folding closure of a package whose outside surfaces are provided with a thermoplastic material.

For the pressing and cementing of a fillet seam on the bottom of a package, it is known to press the fillet seam by means of movable parts whose movement is automatically controlled. In this known method, additional drives are required for the parts pressing the fillet seam.

THE INVENTION

It is the object of the invention to devise a method and a simple apparatus for the reliable and rapid pressing and sealing down of a fillet seam.

This object is accomplished by the invention in that the package is transported with the fillet seam disposed transversely of the direction of transport, at least one area of the trailing face of the fillet seam and an area of the outside of the package adjacent said trailing face are heated by at least one hot air source, and then the package is transported beneath a stationary surface by which the fillet seam is pressed down against the outside surface of the package as the package brushes past it.

In the method of the invention, no moving parts are needed. Instead, the fillet seam is pressed down against the package surface and sealed down by the movement of the package. Cooling of the areas heated by the hot air is effected by the stationary surface, and also by the material contained within the package.

In order to achieve an especially gentle pressing down of the fillet seam, the stationary surface can be provided with a ramp inclined downwardly in the direction of transport at the end which first engages the package. Also, the stationary surface can be provided with forced cooling so as to achieve an especially rapid cooling of the heated areas.

In an especially advantageous development, the invention proposes that two hot air sources be disposed such that the heated areas will be at the ends of the fillet seam, in order to have between them a relatively large, unsealed area into which the finger tips can be inserted for easy opening.

An example of the embodiment of the invention is represented in the drawing and will now be described in detail.

Figure 1:
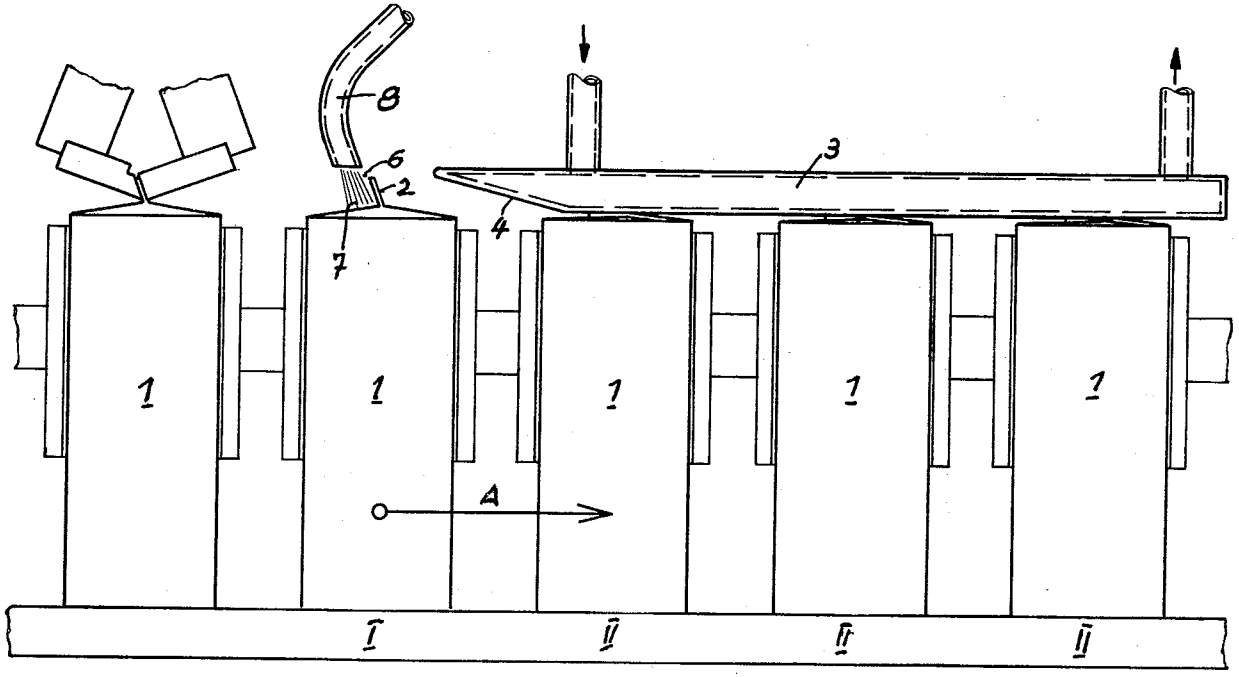
FIG. 1 is a side elevational view of the apparatus.
Figure 2:
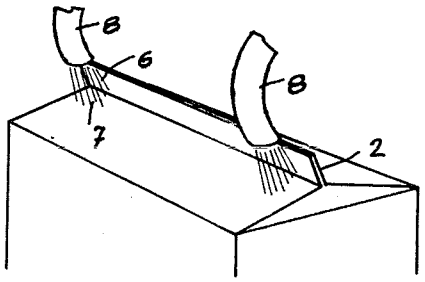
FIG. 2 is a perspective view of a detail of FIG. 1.

The drawing shows a parallelipipedal package 1 having a roof-shaped folded closure at the top, on whose ridge a strip projects vertically or at a slight inclination towards the side toward which it is to be folded downwardly, the said strip being a fillet seam 2 formed of the uppermost margins of the sides of the package which have been cemented or fused together (sealed). The packages are standing in line in cells of a filling machine and are advanced by the cells from one working station to the next in the direction of the arrow A. At each station the packages stand still for about one second, and for the movement from one station to the next the packages require approximately 0.45 seconds.

At the working station I represented in the drawing, areas are heated which are located in back of the fillet seam 2 disposed transversely of the direction of advancement. For this purpose, two tubes 8, disposed at opposite sides of the package, are directed downwardly at the package; they are connected to a source of hot air and they heat two areas 6 on the trailing face of the fillet seam 2 as well as two areas 7 of the roof-like surface adjacent thereto. These areas are selected such that, when the fillet seam is folded down, two areas will be superimposed on each side of the package.

At the next stations II a stationary surface 3 extends across the width of the packages close to their tops; the front margin 4 of said stationary surface 3 is beveled upwardly such that, when the packages pass beneath the surface, the fillet seams 2 are folded back and pressed downwardly and thus become cemented or fused (sealed) down. To intensify the downward pressure on the folded fillet seam, the underside of the surface can be provided with beads which press at least on the heated areas when the package stops. A very rapid cooling of the heated areas is accomplished by the fact that the stationary surface is force-cooled, and the content of the package, milk, for example, provides additional cooling from within.

It will be appreciated that the instant specification and examples are set forth by way of illustration and not limitation, and that various modifications and changes may be made without departing from the spirit and scope of the present invention.

What is claimed is:

1. A method for flat pressing and sticking down of a fillet seam of a roof-shaped folding closure of a package whose outside surface is provided with a thermoplastic material, comprising
   (a) transporting the package in a direction transverse to the fillet seam,
   (b) heating a first area comprising a portion of the side surface of the fillet seam rearward of the seam relative to the direction of transport and heating a second area comprising a portion of the outside surface of the package complementary with the first area, and,
   (c) transporting the package partially heated as to the first and second areas thereof past a stationary member positioned so as to press the fillet seam in response to the movement of the package in the direction transverse to the fillet seam and cause it to stick down to the outside surface of the package.

2. The method according to claim 1, including heating a third area comprising a portion of the side surface of the fillet seam rearward of the seam and a fourth area comprising a portion of the outside surface of the package complementary with the third area so that the package is also partially heated as to the third and fourth areas thereof, the first and third areas and the second and fourth areas being respectively spaced apart and substantially simultaneously heated, whereby after sticking of the fillet seam to the package surface the sticking down can be undone by pulling in the space between the first and third areas.

3. An apparatus for carrying out the method of claim 1, comprising
   (a) means for transporting the package in a direction transverse to the fillet seam,
   (b) means for heating the first and second areas comprising a portion of the side surface of the fillet seam relative to the direction of transport and a portion of the outside surface of the package complementary with the first area, respectively, during transport of the package, and (c) stationary means positioned relative to the transporting means and responsive to the movement of the package in the direction transverse to the fillet seam so as to flat press the fillet seam as the package is transported past the stationary means to effect sticking down.

4. An apparatus according to claim 3, the stationary means including a portion inclined downwardly in the transport direction so as progressively to bend down the fillet seam as the package is transported.

5. An apparatus according to claim 3, including means for cooling the stationary means so as to set the sticking down.

6. An apparatus according to claim 3, the heating means including a pair of spaced heaters, one heater heating the first and second areas while the second heater simultaneously heats a third area comprising a portion of the side surface of the seam rearward of the seam and a fourth area comprising a portion of the outside surface of the package complementary with the third area, the fillet seam thereby being stuck down at two spaced locations and being capable of being raised by pulling between said spaced locations.

7. An apparatus according to claim 6, the stationary means including a portion inclined downwardly in the transport direction so as progressively to bend down the fillet seam as the package is transported, the apparatus further including means for cooling the stationary means so as to set the sticking down.

* * * * *